US006020074A

United States Patent [19]

Scandagliato et al.

[11] Patent Number: 6,020,074

[45] Date of Patent: Feb. 1, 2000

[54] PROCESS FOR DEPOSITING METAL THREAD OR TAPE ON A SHEET, APPARATUS THEREFOR AND ARTICLES MADE THEREOF

[75] Inventors: Salvatore Scandagliato, Athis Mons; Didier Seigneur, Breteuil, both of France

[73] Assignee: Soplaril S.A., Puteaux, France

[21] Appl. No.: 08/829,548

[22] Filed: Mar. 28, 1997

[30] Foreign Application Priority Data

Mar. 29, 1996 [FR] France ..... 96 03949

[51] Int. Cl.[7] ..... B21D 39/00; D02G 3/00; B21F 3/04

[52] U.S. Cl. ..... 428/593; 428/369; 428/608; 428/611; 428/650; 428/900; 242/430; 242/471; 340/572.1; 340/572.6; 340/572.8

[58] Field of Search ..... 428/593, 601, 428/608, 611, 369, 650, 900, 77, 195; 340/568.1, 572.1, 572.6, 572.8; 427/128; 156/272.4; 283/82; 242/430, 471

[56] References Cited

U.S. PATENT DOCUMENTS

| | | | |
|---|---|---|---|
| 4,743,890 | 5/1988 | Hilzinger et al. | 340/551 |
| 4,945,339 | 7/1990 | Yamauchi et al. | 340/551 |
| 4,960,651 | 10/1990 | Pettigrew et al. | 428/607 |
| 5,063,367 | 11/1991 | Lee | 335/284 |
| 5,181,021 | 1/1993 | Lee et al. | 340/572 |
| 5,560,970 | 10/1996 | Ludebuhl | 428/41.9 |
| 5,728,237 | 3/1998 | Herzer | 148/304 |

FOREIGN PATENT DOCUMENTS

| | | |
|---|---|---|
| 130286 | 1/1985 | European Pat. Off. . |
| 295028 | 12/1988 | European Pat. Off. . |
| 2080075 | 1/1982 | United Kingdom . |

*Primary Examiner*—Paul Thibodeau
*Assistant Examiner*—Holly C. Rickman

[57] ABSTRACT

Process for depositing at least one thread or tape (3*a*, . . . 3*d*), generally a metal thread or tape, in particular made of magnetic material having a high permeability for an antitheft protection system, on a thin sheet (2) especially a plastic, paper or aluminum sheet, this sheet (2) being able to be joined to another sheet (1) with the thread or tape (3*a*, . . . 3*d*) sandwiched between them, the sheet (2) thus furnished with the thread or tape being intended subsequently to be wound up into a reel. The thread or tape (3*a*. . . 3*d*) is placed on the sheet (2) along a line (S) which is sinuous with respect to the longitudinal direction (D) of the sheet, the parameters (p, a) of the sinuosity being chosen so that, in a reel formed with the sheet, in one and the same plane passing through the axis of the reel, the thread or tape sections lying in two adjacent turns in the reel and in one and the same plane passing through the axis of the reel are offset transversely.

14 Claims, 5 Drawing Sheets

PROCESS FOR DEPOSITING METAL THREAD OR TAPE ON A SHEET, APPARATUS THEREFOR AND ARTICLES MADE THEREOF

TABLE OF CONTENTS

1. Background of The Invention
1.1 Technical Field
1.2 Description of The Related Art
2. Summary of The Invention
3. Brief Description of The Drawings
4. Description of The Preferred Embodiments
5. Claims
6. Abstract of The Disclosure
7. Drawings

1. BACKGROUND OF THE INVENTION

1.1 Technical Field

The invention relates to a process for depositing at least one thread or tape, generally a metal thread or tape, on a thin sheet, especially a plastic, paper or aluminum sheet, this sheet being able to be joined to another sheet with the thread or tape sandwiched between them, the sheet furnished with the thread or tape subsequently being wound up into a reel, in particular for transportation and/or storage.

The invention relates more particularly, but not exclusively, to the deposition of a metal thread or tape made of magnetic material having a high permeability for a system for protecting against the theft of articles in stores.

1.2 Description of Related Art

Thin sheets or films of plastic, paper, aluminum or other material, furnished with a metal thread or tape, in particular a magnetic one, are being increasingly used either for the closure of containers containing products or for the manufacture of labels affixed to the products, so as to be able to provide, by virtue of the presence of the metal thread or tape, information on the product or antitheft protection, by detecting the metal thread or tape with a suitable system.

Examples of devices enabling articles to be detected using such magnetic metal threads or tapes are provided, inter alia, by EP-A-0,130,286, EP-A-0,295,028 or WO 92/07343. The metal thread or tape is made of a magnetic material having a high permeability, for example an alloy known by the name "permalloy".

The thickness of the metal thread or tape placed on the sheet of plastic or other material is relatively small, but nevertheless constitutes an additional thickness which is added to the thickness, also relatively small, of the sheets between which this thread or tape is sandwiched.

The sheets thus equipped are manufactured in long length, for example a length of several tens of meters, and are wound up into reels for storage and/or transportation, these sheets subsequently being cut into individual sheets, for example to make lids for containers or labels, depending on the application envisaged.

The reels of sheet thus formed have a relatively large number of turns. Under these conditions, if the metal thread or tape is arranged parallel to the length of the sheet (see FIG. 1*a*) while the latter is being wound up about an axis orthogonal to its length, the additional thicknesses of the thread or tape come to be superimposed in the wound reel (see FIG. 1*b*) and to create a protuberance possibly resulting in deformations which can damage the sheets to which a metal thread or tape is fixed.

2. SUMMARY OF THE INVENTION

The object of the invention is, above all, to provide a process enabling a thread or tape, in particular for detecting theft, to be placed on a sheet or to insert this thread or tape between two sheets, in such a way that the drawbacks mentioned hereinabove are eliminated, or at the very least substantially reduced.

It is furthermore desirable that this process be simple and quick to implement and be relatively economic.

According to the invention, this process for depositing at least one thread or tape, generally a metal thread or tape, on a thin sheet, especially made of plastic, paper or aluminum, this sheet being able to be joined to another sheet with the thread or tape sandwiched between them, the sheet being intended subsequently to be wound up into a reel, in particular for transportation and/or storage, is distinguished by the fact that the thread or tape is placed on the sheet along a line which is sinuous or zigzagged with respect to the longitudinal direction of the sheet, the parameters of the sinuous line, in particular the pitch and the amplitude, being chosen so that, in the reel formed with the sheet, the thread or tape sections lying in adjacent turns of the reel and in one and the same plane passing through the axis of the reel are offset transversely.

Preferably, the parameters of the sinuosity are provided so that the thread or tape sections lying in two adjacent turns of the storage reel and in one and the same plane passing through the axis of the reel are sufficiently offset transversely not to overlap each other.

Advantageously, several threads or tapes are placed along parallel sinuous lines on one and the same sheet or between two sheets, the sinuosities of one and the same thread or tape lying between two limits parallel to the longitudinal edges of the sheet, defining a unit width in which a single thread or tape is present, this unit width being able to be cut along the length of the sheet.

For the deposition, the sheet or sheets are made to run and the thread or tape is unwound and applied against the support sheet, and the thread or tape is given an alternating translational motion, along a direction which is transverse to that in which this thread or this tape is unwound, while the sheet is running.

Advantageously, the value of the transverse amplitude of the sinuosity of the thread or tape is modulated in order to take into account the radius of winding in the reel, at the relevant region of the sheet.

The invention also relates to a machine for implementing the process, which comprises a frame supporting two parallel rollers, between which at least one sheet on which the metal thread or tape has to be deposited passes, and at least one pay-out supporting a roll of thread or tape, generally a metal thread or tape, to be applied against the sheet, this machine being one which includes a guide capable of oscillating transversely with respect to the direction of advance of the sheet, this oscillating guide being arranged between the pay-out and the rollers and the metal thread or tape passing through this oscillating guide in order to give them the transverse oscillatory motion.

The machine may include several pay-outs fixed above and below a pay-out support extending transversely with respect to the direction of advance of the sheet, while the oscillating guide includes at least as many transversely distributed passages as there are pay-outs.

The oscillating guide may include a support plate on which several modular elements are fixed, each modular element including passage grooves for the thread or tape, the edges of these grooves forming a V which is open toward the pay-outs and the tip of which is turned toward the rollers between which the sheet receiving the thread passes.

A cooling circuit may pass through a modular element of the oscillating guide, including the grooves.

Advantageously, each pay-out for the thread or tape includes a brake acting, via a friction wheel carried by an elastically stressed presser arm, against a flange of the reel of thread or tape.

The oscillating guide may be controlled, in its transverse movement, by an eccentric engaged in an elongate opening in a piece fastened to the oscillatingguide support plate, the eccentric being rotationally driven by a motor having a vertical axis, in particular a compressed-air motor.

The invention also relates to a sheet, in particular a plastic, paper or aluminum sheet, which includes at least one thread or tape, generally a metal thread or tape, in particular made of magnetic material having a high permeability for a system for protecting against the theft of articles, this sheet being able to be joined to another sheet with the thread or tape sandwiched between them, wherein the thread or tape is placed on the sheet along a line which is sinuous or zigzagged with respect to the longitudinal direction of the sheet.

The sheet may include several threads or tapes placed along parallel sinuous lines, the sinuosities of one and the same thread or tape lying between two limits parallel to the longitudinal edges of the sheet, defining a unit width in which a single thread or tape is present, this unit width being able to be cut along the length of the sheet.

Finally, the invention relates to a reel of sheet including at least one thread or tape, generally a metal thread or tape, in particular made of magnetic material having a high permeability for a system for protecting against the theft of articles, fixed to this sheet or sandwiched between the sheet and another sheet joined thereto, this reel being one in which the transverse sections of the thread or tape, in a plane passing through the axis of the reel in two adjacent turns, are offset transversely with respect to each other.

The sheet of the reel may include several parallel sinuous threads or tapes.

Apart from the arrangements presented hereinabove, the invention consists of a number of other arrangements which will be explained in more detail below with regard to an embodiment example which is described with references to the drawings appended hereto but which is in no way limiting.

3. BRIEF DESCRIPTION OF THE DRAWINGS

FIG. 1*a* of these drawings is the diagrammatic plan view, with parts cut away, of an assemblage of two sheets between which a metal tape is sandwiched, parallel to the edges of the sheets.

FIG. 1*b* is a partial diagrammatic sectional view of a reel made with the sheet in FIG. 1*a*, wound up around an axis perpendicular to the large dimension of the sheet, this sectional view being in a plane passing through the axis of the reel.

Figure 11:
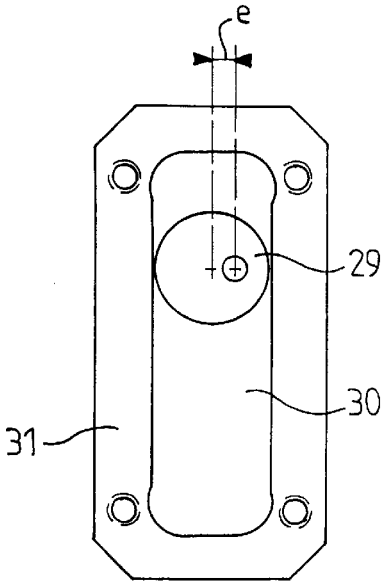

Finally, FIG. 11 is a plan view of a piece with an elongate opening capable of interacting with an eccentric for controlling the oscillatory motion.

4. DESCRIPTION OF THE PREFERRED EMBODIMENTS

Figure 1A:
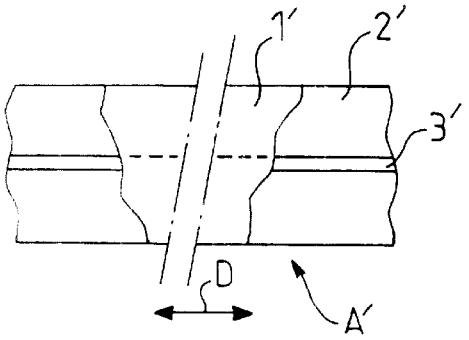

In FIG. 1*a* of the drawings may be seen an assemblage A, of two plastic films or sheets 1', 2' having longitudinal edges parallel to a direction D. A metal tape 3' made of magnetic material, having a high permeability, for example made of "permalloy", is sandwiched between the sheets 1' and 2'. This tape 3' is intended to allow detection, by means of a suitable system, of the passage of a container or of an article provided, either in the form of a lid or in the form of a label, with a portion of this assemblage A', including a part of the tape 3'. The tape 3' is parallel to the long side of the sheets 1', 2' in the case of FIG. 1*a*.

Figure 1B:
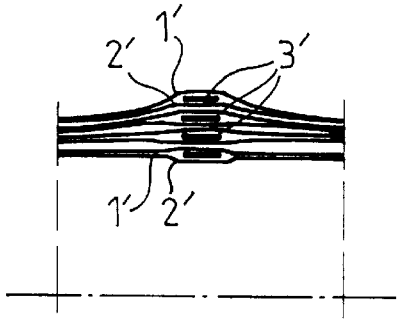

Under these conditions, when the assemblage A, is wound up around an axis orthogonal to the direction D, in order to form a reel, the various sections of the tape 3' lying in successive turns end up being superimposed, as illustrated in FIG. 1*b*, which results in a nonnegligible protuberance causing substantial deformation of the sheets 1' and 2' on either side of this protuberance, possibly leading to the individual sheets cut, generally transversely to the direction D, from the assemblage A', after a certain storage time, being rendered unsuitable for use.

Figure 2:
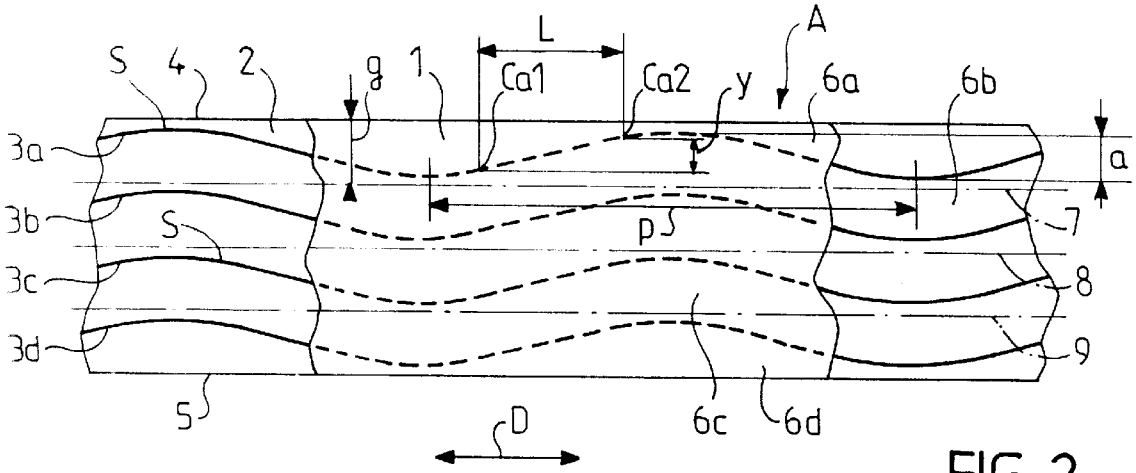
FIG. 2 shows, in a manner similar to FIG. 1*a*, an assemblage, according to the invention, of two sheets between which metal tapes are sandwiched.
Figure 3:
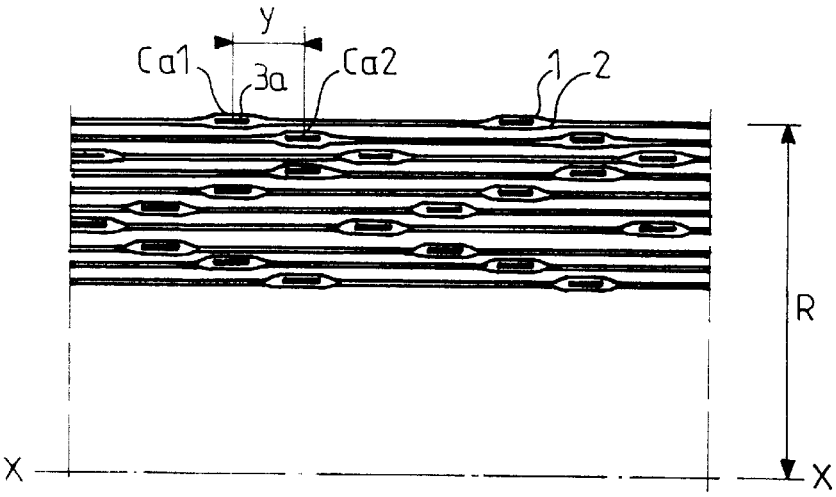
FIG. 3 is a partial diagrammatic sectional view, similar to FIG. 1*b*, of a reel made with the sheet in FIG. 2, according to the invention.

In order to remedy this drawback, according to the process of the invention, illustrated in FIG. 2, the thread or tape 3*a* is placed on the sheet 2, or is inserted between two sheets 1 and 2 forming an assemblage A, along a line S which is sinuous, or zigzagged, with respect to the longitudinal direction D of the sheet 2. The parameters of the sinuosity S, more particularly the pitch p and the amplitude a of the sinuosity or of the zigzag, are chosen so that, in a reel shown partially in FIG. 3, the sections Ca1, Ca2 of the tape 3*a* in one and the same plane passing through the axis X—X of the reel, and lying in two adjacent turns, are offset transversely by a distance y. Preferably, this distance y is long enough for the sections Ca1 and Ca2 not to overlap each other, as illustrated in FIG. 3. In other words, y is preferably at least equal to the width of the tape 3*a*, generally of the order of a few millimeters. The same is true for the transverse sections of the tape 3*a* of the other turns.

Referring to FIG. 2, which represents the development of the assemblage A wound up into a reel in FIG. 3, it may be seen that the sections Ca1 and Ca2 are separated by a length L equal to. one revolution of a turn in the reel, i.e. $2\pi R$, R being the average radius of the two turns to which the sections Ca1 and Ca2 belong. The slope of the sinuous part lying between the sections Ca1 and Ca2, in FIG. 2, must be chosen so that the transverse distance y, shown again in FIG. 3 (this being drawn, however, on a different scale), is great enough to ensure the desired offset.

In order to take into account the fact that the radius R of the turns in the reel increase progressively passing from an inner turn to an outer turn, it is possible to modulate the parameters of the sinuosity S.

Preferably, several tapes, namely four tapes 3*a*, 3*b*, 3*c*, 3*d* in the case of FIG. 2, are placed along parallel sinuous lines between the two sheets 1 and 2. The sinuosities of any one tape 3*a* . . . 3*d* lie between two limits parallel to the longitudinal edges 4, 5 of the sheet so as to define a unit width 6*a*, . . . 6*d* in which a single metal tape 3*a* . . . 3*d* is present. This unit width may subsequently be cut along the length of the sheet and be used separately. The unit width 6*a* is delimited by the edge 4 and by a parallel line 7 which may be imaginary or actually made to appear by printing on the assemblage A. The unit width 6*b* lies between the lines 7 and 8, the unit width 6*c* between the lines 8 and 9 and the unit width 6*d* between the line 9 and the other edge 5. The width g of the unit width is preferably constant. The sinuosities of the tapes 3*a*, . . . 3*d* are centered within the respective unit width so that on either side of the peaks of the sinuosity there is a clearance distance between this peak and the neighboring edge of the unit width equal to (g−a)/2.

In FIGS. 4 to 7 may be seen a machine for implementing the process according to the invention.

Figure 4:
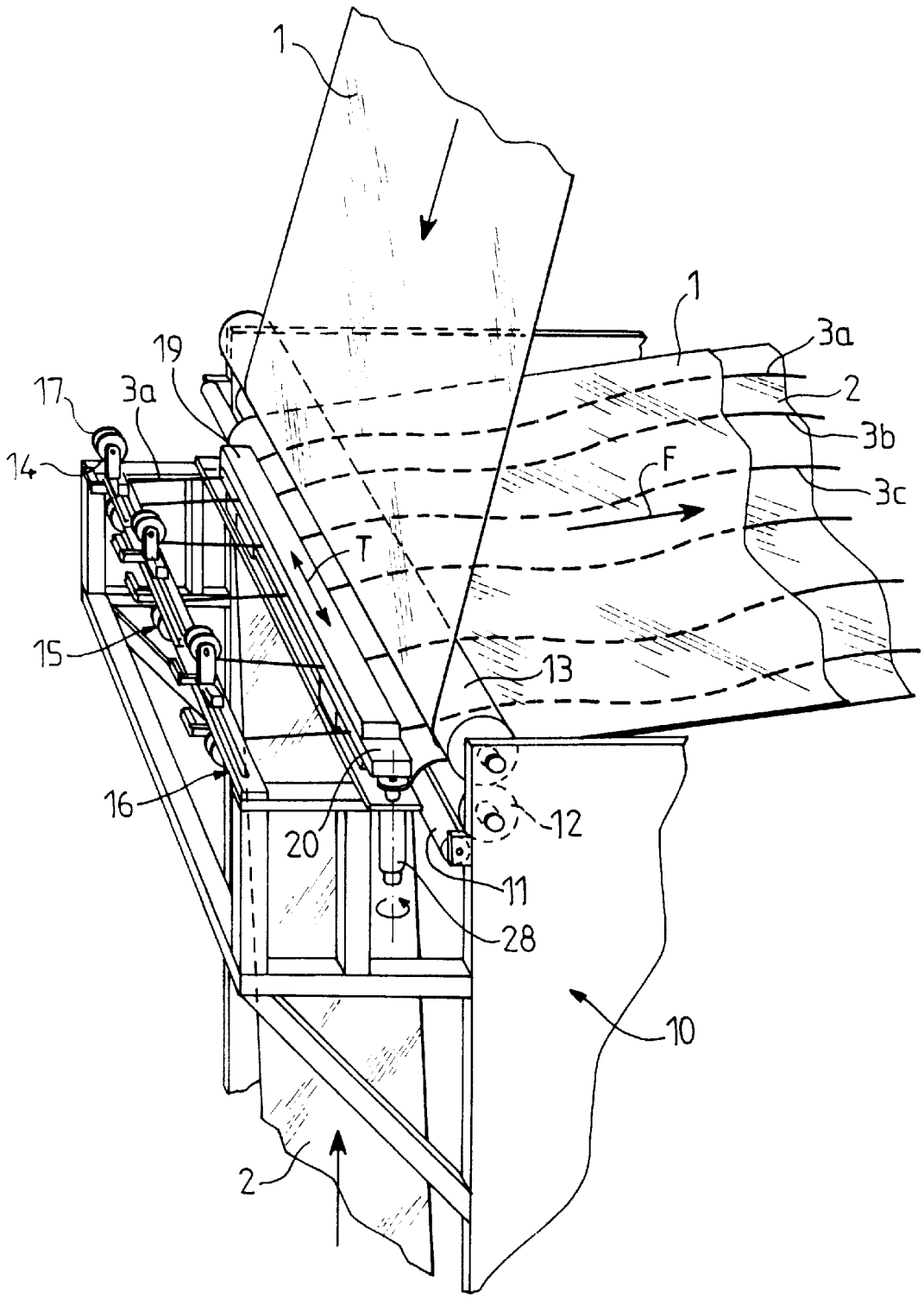
FIG. 4 is a perspective diagrammatic view of part of a machine for implementing the process according to the invention.

As may be clearly seen in FIG. 4, the machine includes a frame 10 carrying a first rotary roller 11, oriented transversely to the direction of advance of the sheets 1 and 2. This first roller 11 is provided for coating with adhesive that face of the plastic sheet 2 which will be in contact with the other sheet 1.

Two other rotary rollers 12, 13, which are superimposed and lie downstream of the roller 11 with respect to the direction of advance F of the sheets, are provided for laminating the two sheets 1 and 2 which pass between them. The upper sheet 1 is wound up around the upper roller 13 while the lower sheet 2 passes around the lower roller 12. The rollers 12 and 13 ensure that the adhesively coated sheet 2 is joined to the other sheet 1, by calendaring.

To the rear of the rollers 12, 13, with respect to the direction of the arrow F, the machine. includes several upper pay-outs 14 and lower pay-outs 15 which are fixed above and below a pay-out support 16 extending transversely to the direction F. Each pay-out supports, so as to be able to rotate, a reel 17 of metal tape 3*a*, 3*b*, 3*c*, etc. to be inserted between the sheets 1 and 2 along a sinuous line, as explained with regard to FIG. 2. As may be seen in FIG. 5, each pay-out is equipped with a device B, described in detail later, for braking the associated reel 17.

Each pay-out 14 or 15 is mounted so as to be able to slide on a transverse beam which forms the support 16 and includes grooves capable of interacting with devices 18 for locking the pay-out in the desired position.

A guide 19, capable of oscillating transversely along the double arrow T (FIG. 4), perpendicular to the direction of advance F, is arranged between the pay-outs 14, 15 and the rollers 12, 13. The metal tapes or threads 3*a*, . . . 3*c*, etc. to be inserted between the sheets 1 and 2 pass-through this oscillating guide 19 which communicates to them an alternating translational motion, along the transverse direction T, while the sheets 1 and 2 run along the direction F.

The oscillating guide 19 includes a support plate 20 to which several modular elements 21 for guiding the metal tapes 3 are fixed. In the example shown in FIG. 5, five modular elements 21 are fixed to the support plate 20.

Figure 5:
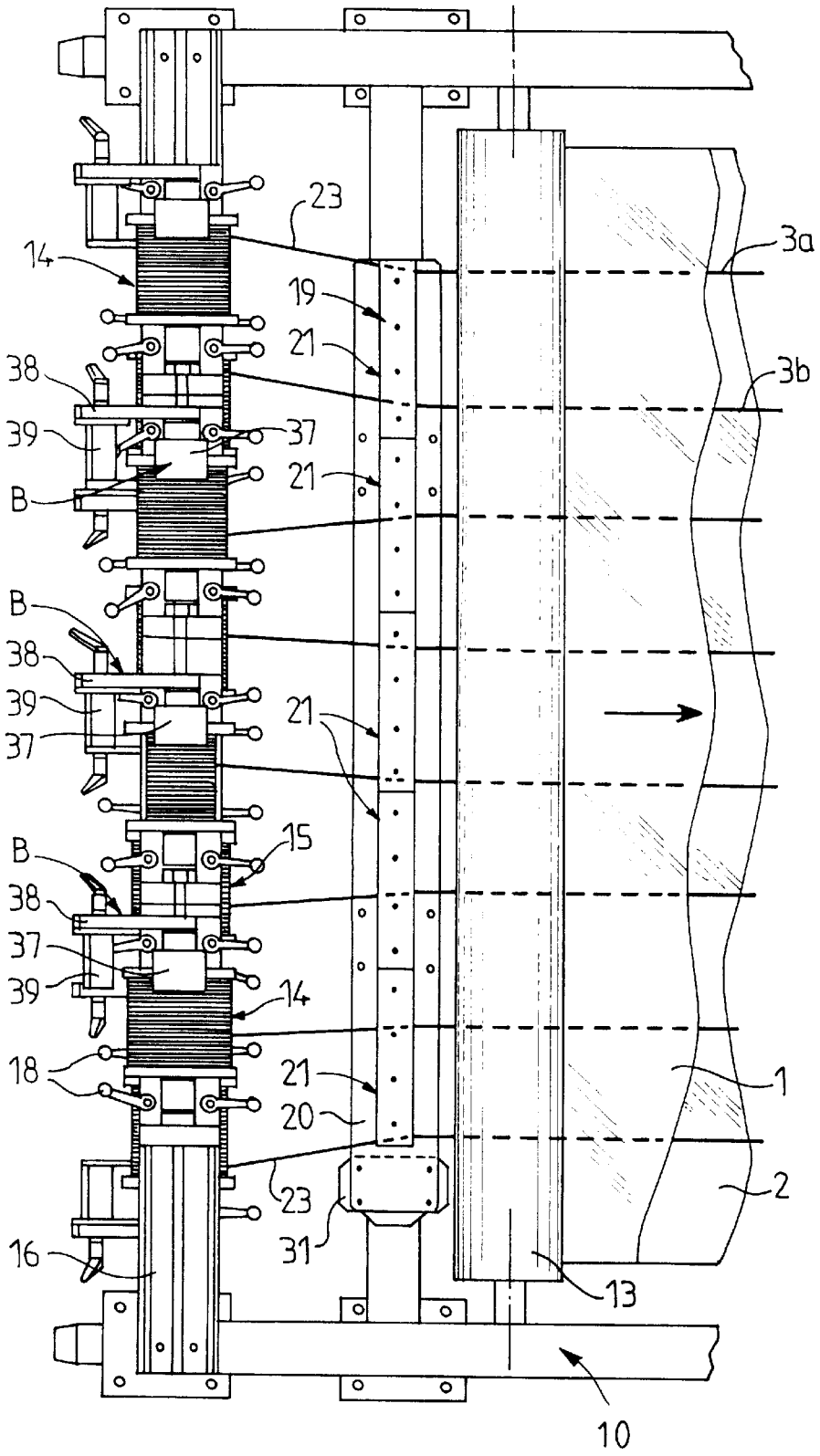
FIG. 5 is a partial view, from above, of the machine in FIG. 4.
Figure 7:
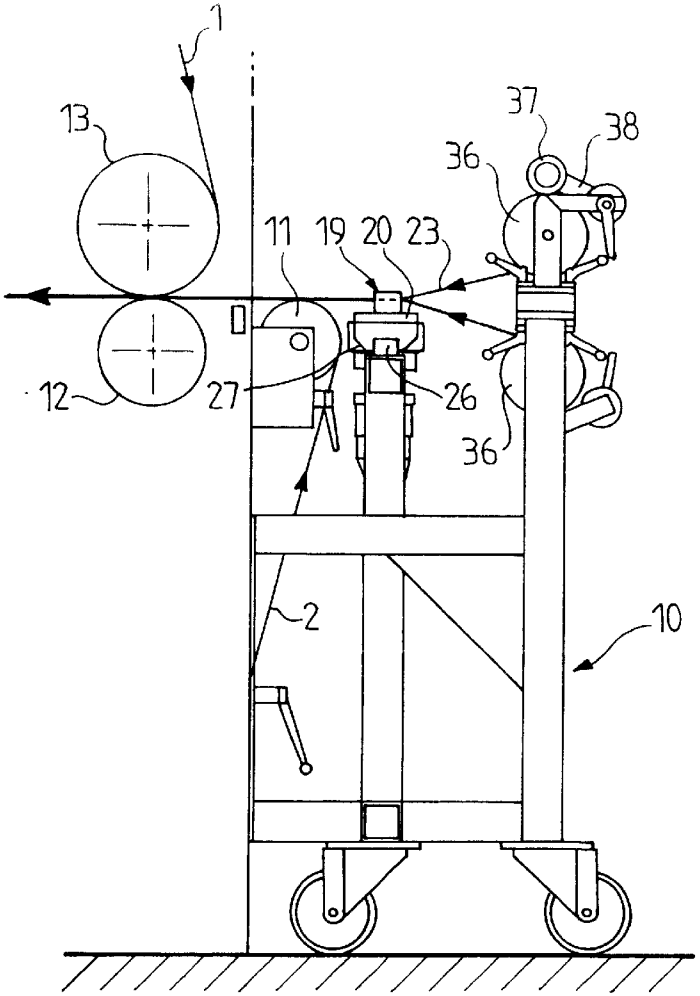
FIG. 7 is a view, to the right with respect to FIG. 6, of part of the machine.
Figure 6:
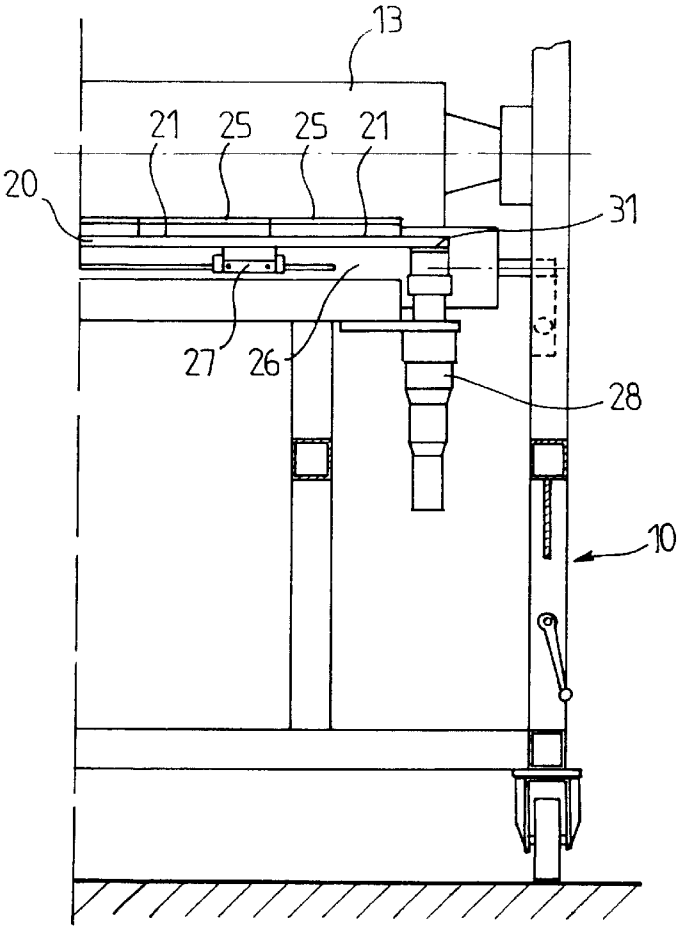
FIG. 6 is a partial view to the left with respect to FIG. 5.
Figure 8:
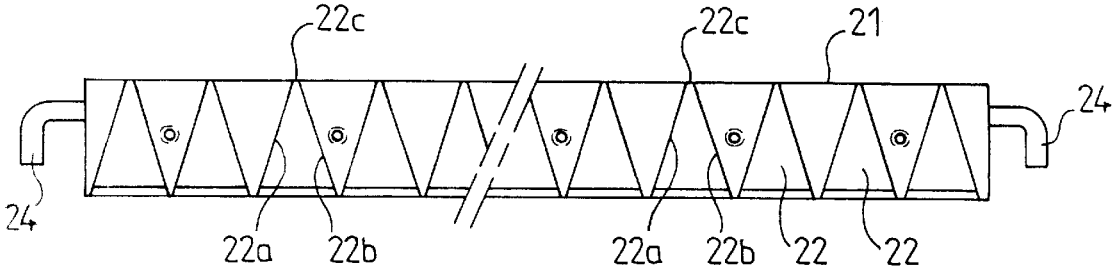
FIG. 8 is a plan view of a modular element of the oscillating guide for the thread or tape to be inserted.
Figure 9:
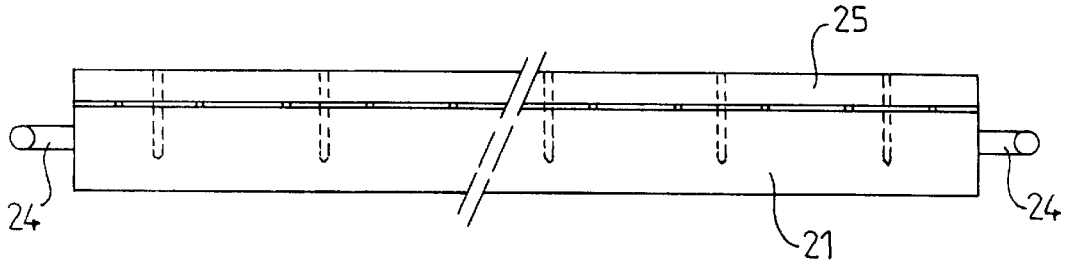
FIG. 9 is a front view of the element in FIG. 8, on which a cover is placed.

A modular element 21, as illustrated in FIG. 8, is formed by a kind of rectangular parallelepipedal unit, the upper face of which includes passage grooves 22 for the tapes 3*a*, . . . 3*d*. The edges 22*a*, 22*b* of each groove form a V which is open rearward toward the pay-outs 14, 15 and the tip 22*c*, defining a passage slit, of which V is turned toward the rollers 12, 13. Each modular element 21 includes several equally distributed grooves 22. As illustrated in FIG. 5, only a certain number of these grooves may be used, depending on the number of tapes 3*a*, . . . 3*d* to be inserted between the sheets 1 and 2. The apex angle of the grooves 22 is designed to allow free angular oscillation of the length 23 (FIG. 5) of tape between a pay-out 14, 15 and a groove 22. Preferably, each modular element 21, as illustrated in FIGS. 8 and 9, includes an internal circuit for a coolant (for example, air or water) furnished at its ends with nozzles 24 for connection. A lid 25, fixed to the element 21, sits over the upwardly open grooves 22 on the upper face of the modular element. The entry edges of the grooves are bevelled.

The support plate 20 is mounted so as to slide on a transverse bench 26, by means of a ball-type guiding system 27. The transverse movements of the support plate 20 are caused by a motor 28, having a vertical axis, the casing of which is fixed to the frame 10 of the machine. An eccentric 29 is keyed onto the output shaft of the motor 28. This eccentric 29 is engaged in a rectangular opening or window 30 (FIG. 11) of a wafer-shaped piece 31 fixed to the support plate 20, the large dimension of which piece is oriented parallel to the direction F of the sheets 1 and 2. The longitudinal edges of the window 30 are parallel and separated by a distance equal to the diameter of the eccentric 29. Thus, rotation of the eccentric inside this window 30 communicates only the transverse oscillatory motion to the piece 31, to the support plate 20 and to the guide 19.

The eccentricity e of this eccentric 29 determines the amplitude a (FIG. 2) of the sinuous line. The speed of rotation of the motor 28, and therefore of the eccentric 29, enables the pitch p of the sinuous line to be adjusted (FIG. 2), taking into account the run speed of the sheets 1 and 2. For a constant run speed of the sheets 1 and 2, it is possible to modulate the pitch p by varying the speed of rotation of the motor 28. Advantageously, this motor 28 is a compressed-air motor.

Figure 10:
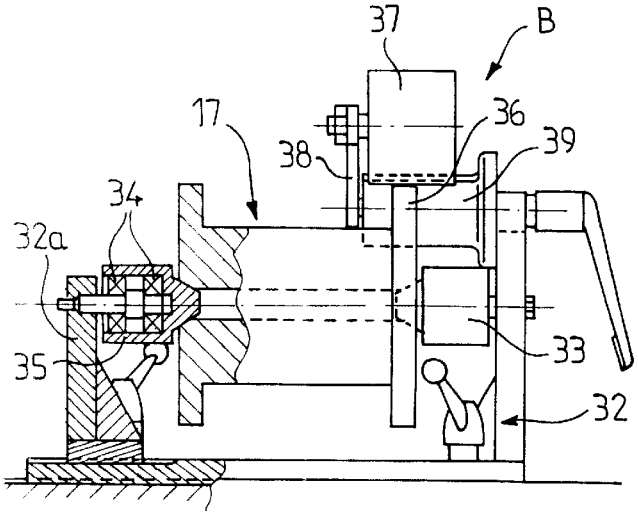
FIG. 10 is a partly sectional, partly front view of the way in which a pay-out for the metal thread or tape to be inserted is mounted.

FIG. 10 illustrates an embodiment of a pay-out 14, 15. The pay-out includes a baseplate 32 having an upright provided with a center 33 mounted so as to rotate on ball bearings such as 34. Another upright 32*a*, mounted so as to be able to be adjusted on the baseplate 32, with a means for locking it in the desired position, is provided and includes another center 35 also mounted so as to rotate on ball bearings 34, the axis of which is aligned with that of the center 33. A reel 17, for the metal thread or tape to be inserted between the sheets 1 and 2, is locked between the centers 33 and 35 and may thus rotate freely with these centers. The reel 17 has a flange 36 at each end.

The braking device B mentioned above is designed to act on the periphery of the flange 36 lying on the same side as the center 33. The braking device B comprises a friction wheel 37, having an axis parallel to that of the centers 33, 35, and capable of rolling against the periphery of the flange 36. This wheel 37 is carried by a presser arm 38 which may rotate about an axis parallel to that of the reel 17. The arm is elastically stressed, in the direction which applies the wheel 37 against the flange 36, by a helical torsion spring (not visible) arranged in a cylindrical casing 39 parallel to the axis of the reel. The braking exerted by the wheel 37 is adjustable.

This braking system on each reel of magnetic tape 3 makes it possible to guarantee a constant tension during insertion of the thread between the sheets 1 and 2.

The operation of the machine results immediately from the above explanations, without it being necessary to describe it in detail.

The assemblages A, especially plastic sheets 1 and 2, involved in the embedment of a magnetic thread or tape, are highly diverse. Mention may be made of the following assemblages: PA/PE (PA=polyamide/PE=polyethylene); PA/CPP (polyamide/CPP=cast polypropylene); OPA/PE (OPA=oriented polyamide/polyethylene); metallized OPA/PE; metallized OPA/CPP; PET (polyethylene terephthalate)/PE; aluminum/PE; PP (polypropylene)/PE; metallized PP/PE; paper/PE; PVC/PE; coextruded/coextruded.

All polyethylene types (whether or not peelable) may be used.

The thickness of the sheets 1 and 2 before they have been joined together may vary from 10 $\mu$m (micro-meters) to 850 $\mu$m. The thickness of the metal tape 3 is generally of the order of a few $\mu$m while its width is of the order of a millimeter or a few mm.

The assemblage A of the two sheets 1, 2, between which magnetic threads or tapes 3*a*, . . . 3*d* have been inserted, may be complexed with a third sheet or ply, or with any other assemblage of two or three films.

The adhesives employed for joining the sheets 1 and 2 together are highly diverse. They may be a waterbased adhesive, a solvent-based adhesive, a solventless adhesive, a one-component adhesive or a multi component adhesive.

The number of threads or tapes 3 deposited depends on the requirement. In the example in FIG. 5, eight tapes 3 are deposited, these coming from four upper pay-outs 14 and four lower pay-outs 15.

The position of the tapes 3 also depends on the requirement. The assemblage A may subsequently cut along the length direction and/or in the width direction in order to end up with individual components, such as sheets for lids or for labels.

Depending on the requirement, the tapes 3 may be laid on the recto side or on the verso side of the double-sided article formed by the assemblage A. In all cases, the solution the invention makes it possible to avoid forming a thickened region at the place where the thread or tape 3 is in the reel, as illustrated in FIG. 3.

A reel was produced by way of example. It was made up of a complex of two oriented polypropylenes, each having a thickness of 35 $\mu$m; the width of the two reels of film was 950 mm (sheets 2, 1), with insertion of five polymetalic threads 3. The linear speed of the complex was 40 meters/minute with a peak of 60 meters/minute for 2 minutes. The oscillating guide 19 performed four to-and-fro movements per minute, with an oscillation amplitude of 30 mm (−15 mm and +15 mm with respect to the midpoint). In the case of a complex speed of 40 meters/minute, the pitch of the oscillation is therefore 10 meters. In the case of a complex speed of 60 meters/minute, the pitch of the oscillation goes up to 15 meters. Those parts of the sinuous line S inclined with respect to the direction D were therefore so inclined at a very small angle (in the case of a complex speed of 40 meters/minute: 30 mm transverse movement of the polymetalic thread over a 5 meter length of the complex).

The diameter of the reel obtained was 350 mm, i.e. 700 linear meters. The adhesive used was a Henkel adhesive UR 3850 with a solvent (ethyl acetate).

We claim:

1. A process yielding a composite sheet component of a system for protecting against theft of articles which comprises depositing at least one thread or tape made of magnetic material having a high permeability on a first sheet, said first sheet being joined to a second sheet with the thread or tape sandwiched between them forming said composite sheet, said composite sheet thus furnished with the thread or tape being wound up into a reel, wherein the thread or tape is placed on said first sheet along a line which is sinuous or zigzagged with respect to the longitudinal direction of said first sheet in which the sinuosity is characterized by a pitch and an amplitude, the pitch and the amplitude of the sinuosity being chosen so that, in the reel formed with a plurality of turns of said composite sheet, in one and the same plane passing through the axis of the reel, the thread or tape sections lying in adjacent turns of the reel and in one and the same plane passing through the axis of the reel are offset transversely.

2. The process as claimed in claim 1, further comprising winding said composite sheet to form a reel.

3. The process as claimed in claim 1, wherein a plurality of threads or tapes are placed along parallel sinuous lines on one and the same first sheet and disposed between said first and second sheets, the sinuosities of one and the same thread or tape lying between two limits parallel to the longitudinal edges of said first sheet, defining a unit width in which a single thread or tape is present, this unit width being able to be cut along the length of said first sheet.

4. The process as claimed in claim 1, in which said first sheet or said first and second sheets are made to run and the thread or tape is unwound and applied against said first sheet, wherein the thread or tape is given an alternating translation of motion, along a direction which is transverse to that in which the thread or the tape is unwound, while said first sheet or said first and second sheet are running.

5. The process as claimed in claim 1, wherein the value of the transverse amplitude of the sinuosity of the thread or tape is modulated in order to take into account the radius of winding in the reel, at the relevant region of said composite sheet.

6. A composite sheet for a system for protecting against theft of articles which comprises a first sheet, at least one thread or tape made of magnetic material having a high permeability, said first sheet being joined to a second sheet with the thread or tape sandwiched between them forming said composite sheet, wherein the thread or tape is placed on said first sheet along a line which is sinuous or zigzagged with respect to the longitudinal direction of said first sheet in which the sinuosity is characterized by a pitch and an amplitude, the pitch and the amplitude of the sinuosity being chosen so that, in a reel formed with a plurality of turns of said composite sheet, the thread or tape sections lying in adjacent turns of the reel and in one and the same plane passing through the axis of the reel are offset transversely.

7. The composite sheet as claimed in claim 6, which includes a plurality of threads or tapes placed along parallel sinuous lines, the sinuosities of one and the same thread or tape lying between two limits parallel to the longitudinal edges of said first sheet, defining a unit width in which a single thread or tape is present, this unit width being able to be cut along the length of said first sheet.

8. The composite sheet as claimed in claim 6, wherein said first sheet has a thickness less than 850 $\mu$m.

9. The composite sheet as claimed in claim 6, wherein said first sheet is made of plastic, paper or aluminum.

10. The composite sheet as claimed in claim 6, wherein the thread or tape is made of metal.

11. A reel for a system for protecting against theft of articles comprising at least one turn of a first sheet, said first sheet including at least one thread or tape made of magnetic material having a high permeability, fixed to said first sheet or sandwiched between said first sheet and a second sheet joined thereto, wherein the thread or tape sections which lie in two adjacent turns and in a plane passing through the axis of the reel are offset transversely with respect to each other.

12. The reel as claimed in claim 11, which includes a plurality of parallel sinuous threads or tapes.

13. The reel as claimed in claim 11, wherein said first sheet is made of plastic, paper or aluminum.

14. The reel as claimed in claim 11, wherein the thread or tape is made of metal.

* * * * *